US008818226B2

(12) United States Patent
Asano

(10) Patent No.: US 8,818,226 B2
(45) Date of Patent: Aug. 26, 2014

(54) FIXING DEVICE USING HEATING SCHEME FOR IMAGE FORMING APPARATUS

(75) Inventor: Hiroki Asano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 183 days.

(21) Appl. No.: 13/483,490

(22) Filed: May 30, 2012

(65) Prior Publication Data

US 2012/0321334 A1 Dec. 20, 2012

(30) Foreign Application Priority Data

Jun. 15, 2011 (JP) ..... 2011-133538

(51) Int. Cl.
*G03G 15/20* (2006.01)

(52) U.S. Cl.
CPC ..... *G03G 15/205* (2013.01); *G03G 15/2082* (2013.01)
USPC ..... 399/69; 399/70

(58) Field of Classification Search
CPC ..... G03G 15/205; G03G 15/2042; G03G 15/2078; G03G 15/2082
USPC ..... 399/69–70
See application file for complete search history.

(56) References Cited

U.S. PATENT DOCUMENTS

| | | | | |
|---|---|---|---|---|
| 7,187,882 | B2 | 3/2007 | Kawazu et al. | |
| 7,199,335 | B2 | 4/2007 | Takami et al. | |
| 2005/0258158 | A1 | 11/2005 | Takami et al. | |
| 2008/0267643 | A1 | 10/2008 | Takami | |
| 2009/0304421 | A1 | 12/2009 | Saito et al. | |
| 2010/0215391 | A1* | 8/2010 | Namiki et al. | 399/70 |
| 2013/0121717 | A1* | 5/2013 | Asano | |
| 2013/0266333 | A1* | 10/2013 | Fujiwara | 399/69 |

FOREIGN PATENT DOCUMENTS

| | | | |
|---|---|---|---|
| JP | 2004-226557 | A | 8/2004 |
| JP | 2005-321573 | A | 11/2005 |
| JP | 2008-275900 | A | 11/2008 |

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

When a rotation member stops rotation, driving of a plurality of heating elements is sometimes partially limited. A control unit detects a current flowing to the plurality of heating elements when the rotation member stops rotation, and driving of the plurality of heating elements is partially limited. The control unit sets the power ratio of power to be supplied to the plurality of heating elements during a period in which the rotation member rotates to raise a fixing device to a fixing enable state in accordance with the detection result.

10 Claims, 15 Drawing Sheets

FIXING DEVICE USING HEATING SCHEME FOR IMAGE FORMING APPARATUS

BACKGROUND OF THE INVENTION

1. Field of the Invention

The present invention relates to a fixing device using a heating scheme for an image forming apparatus.

2. Description of the Related Art

Currently, a heat roller scheme using a halogen heater as a heat source or a film heating scheme using a ceramic heater as a heat source is widely used for a fixing device used in an image forming apparatus. Such a fixing device needs a protection mechanism for suppressing damage to components arranged around the pressure roller in the case of overheating.

Especially, when the pressure roller stops rotating, heat generated by the heater escapes to only part of the pressure roller, and the components are readily overheated. To prevent this, Japanese Patent Laid-Open No. 2008-275900 describes providing a rotation detection circuit for detecting rotation of a pressure roller and a hardware safety circuit for limiting and partially driving of heating elements during rotation stop detection by the rotation detection circuit regardless of a heater driving signal output from a CPU.

On the other hand, Japanese Patent Laid-Open No. 2004-226557 (U.S. Pat. No. 7,187,882 B1) describes a circuit arrangement which, before raising a heater to a target temperature, detects the value of a current flowing upon supplying, to the heater, a power corresponding to a predetermined phase angle (that is, supplying a power at a predetermined power ratio) and calculates the upper limit value of the power suppliable to the heater based on the detected current value. With this arrangement, even when the resistance value of the heater and the voltage of the commercial AC power supply vary, the upper limit of the power suppliable to the heater can be calculated in accordance with the state, and the fixing device can be used almost up to the limit of the rated current of 15 A.

In general, the heating process of the fixing device includes a prerise stage, a preheat stage, a rise stage, and a PI control stage. The prerise stage is the stage before the heater is energized. In the preheat stage, a small amount of power is supplied to the heater to generate heat before a full-scale rise up to the target temperature (supply of a large power) (that is, before the start of rotation). Lubricating grease is applied to the sliding surface between the heater and the inner surface of a fixing film. To form a smooth grease coating, the heater is preheated to about 80° C. before rotating the fixing film. In the rise stage, the temperature of the heater is raised up to the target temperature. In the PI control stage, the temperature of the heater is maintained at the target temperature.

In a device including the safety circuit described in Japanese Patent Laid-Open No. 2008-275900, driving of heating elements is partially limited due to the action of the safety circuit (for example, only one of two heaters generates heat) in the preheat stage, that is, in the stage before the start of rotation (rotation stop stage). Hence, the current flowing to the one heater can only be detected in the preheat stage. Hence, the power suppliable to the other heater cannot be calculated. In addition, if the current of the main heater is detected after the preheat stage, the rise time prolongs commensurately.

SUMMARY OF THE INVENTION

The present invention has been made in consideration of the above-described problems, and has as its feature, to provide a fixing device that includes a safety circuit for partially limiting driving of heating elements during stopping of rotation of a rotation member and can set the upper limit of a power suppliable to each of a plurality of heating elements while suppressing an increase in the time of rise of the fixing device to a fixing enable state.

Another feature of the present invention is to provide a fixing device comprising the following elements. A rotation member is used for fixing. A plurality of heating elements is configured to heat the rotation member. A control unit is configured to control power to be supplied to the plurality of heating elements in accordance with temperature information. A circuit is configured to partially limit driving of the plurality of heating elements when the rotation member stops rotation. A current detection unit is provided in a current supply path from a power supply to the plurality of heating elements. The control unit is further configured to set a power ratio of the power to be supplied to the plurality of heating elements during a period in which the rotation member rotates to raise the fixing device to a fixing enable state in accordance with a current detected by the current detection unit when the rotation member stops rotation, and driving of the plurality of heating elements is partially limited.

Further features of the present invention will become apparent from the following description of exemplary embodiments (with reference to the attached drawings).

DESCRIPTION OF THE EMBODIMENTS

First Embodiment

(1) Image Forming Apparatus

Figure 1:
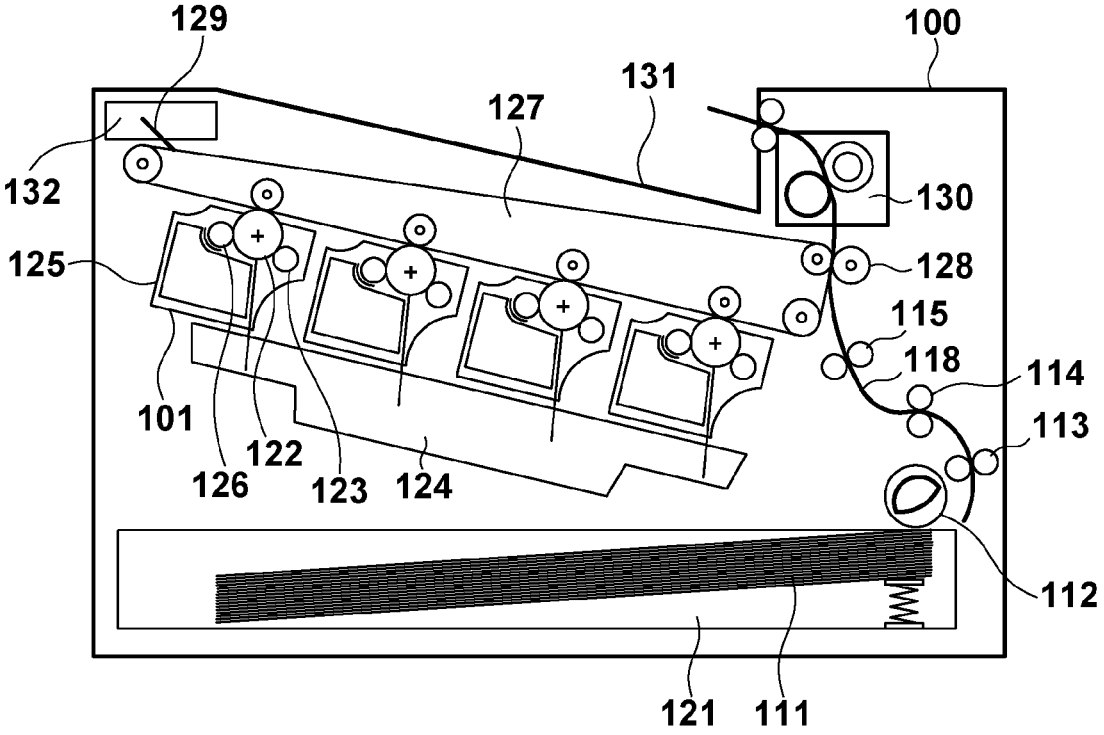
FIG. 1 is a sectional view showing an example of the arrangement of an image forming apparatus according to the first and second embodiments.

FIG. 1 illustrates the schematic arrangement of an image forming apparatus according to the embodiment of the present invention. An image forming apparatus 100 forms a multicolor image by overlaying four color toner images of yellow, cyan, magenta, and black using electrophotography. The image forming apparatus 100 includes four stations corresponding to yellow (Y), magenta (M), cyan (C), and black (K). The stations have a common arrangement. Hence, one station will be explained.

An all-in-one cartridge 101 is formed by integrating a photosensitive drum 122 serving as an image carrier, a charging roller 123 serving as a charger, a developing roller 126 serving as a developer, and the like. The charging roller 123 uniformly charges the surface of the photosensitive drum 122. A scanner unit 124 irradiates the photosensitive drum 122 with exposure light corresponding to image information so as to form an electrostatic latent image on the photosensitive drum 122. The developing roller 126 develops the electrostatic latent image using toner from a toner container 125 so as to form a toner image on the photosensitive drum 122. The toner image is primarily transferred to an intermediate transfer material 127. Toner images of different colors are sequentially primarily transferred, thereby forming a multicolor toner image.

A feed unit 121 causes a feed roller 112 to feed printing paper 111 to a conveyance path 118. Conveyance rollers 113, 114, and 115 convey the printing paper 111 along the conveyance path 118 while sandwiching the printing paper 111. A transfer roller 128 sandwiches the printing paper 111 between it and the intermediate transfer material 127 so as to secondarily transfer the multicolor toner image on the intermediate transfer material 127 to the printing paper 111. The transfer roller 128 functions as a transfer device for transferring the toner image to the printing paper. After that, the printing paper 111 is further conveyed along the conveyance path 118 and arrives at a fixing device 130. The fixing device 130 fixes the multicolor toner image on the printing paper 111 by heat and pressure. The printing paper 111 is finally discharged to a discharge tray 131. A cleaner 129 collects the toner remaining on the intermediate transfer material 127 to a cleaner container 132.

(2) Fixing Device

Figure 2:
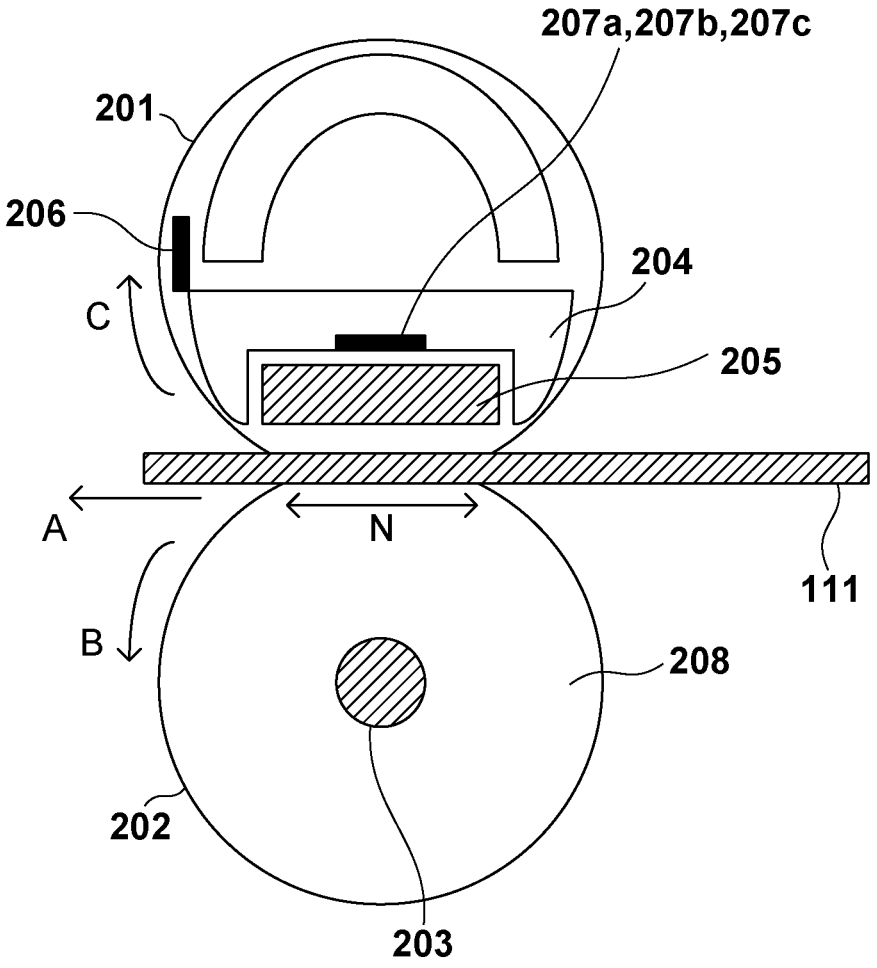
FIG. 2 is a sectional view showing an example of the arrangement of a fixing device according to the first and second embodiments.

The fixing device 130 is assumed to employ a film heating scheme for the descriptive convenience. FIG. 2 shows the schematic arrangement of the fixing device 130. A heater 205 uses ceramic as a base. A plurality of heating elements 302*a* and 302*b* to be described later are formed on the ceramic base. A holder 204 is a support member made of a material having heat-resisting and heat-insulating properties to fix and support the heater 205. A fixing film (rotation member for fixing) 201 is a cylindrical heat-resisting film material that rotates about the heater 205 and the holder 204. A layered structure including a base layer made of polyimide or stainless steel and a fluoroplastic layer formed on the outer surface of the base layer, a layered structure including a base layer made of polyimide or stainless steel, a rubber layer formed on the outer surface of the base layer, and a fluoroplastic layer formed on the outer surface of the rubber layer, or the like is used as the fixing film 201.

A pressure roller 202 is an elastic roller formed by providing a roller-shaped heat-resisting elastic layer 208 made of silicone rubber or the like around a cored bar or metal pipe 203. The pressure roller 202 and the heater 205 are brought into contact with each other while sandwiching the fixing film 201. A range indicated by N in FIG. 2 is the fixing nip portion formed by the pressure contact. The pressure roller 202 is rotatably driven by a driving motor (not shown) in the direction of an arrow B at a predetermined circumferential velocity. As the pressure roller 202 is rotatably driven, the turning force directly acts on the fixing film 201 due to the frictional force between the pressure roller 202 and the outer surface of the fixing film 201 at the fixing nip portion N. The fixing film 201 is thus rotatably driven in the direction of an arrow C while coming into slidable contact with the heater 205. That is, the fixing film 201 rotates while following the pressure roller 202. At this time, the holder 204 also functions as the internal guide member of the fixing film 201 to facilitate the rotation of the fixing film 201.

A sleeve thermistor (first temperature detection element) 206 is a temperature sensor that comes into elastic contact with the inner surface of the fixing film 201 to detect the temperature of the inner surface of the fixing film 201. Heater backside thermistors 207*a*, 207*b*, and 207*c* (second temperature detection elements) are temperature sensors that are pressed against the back surface of the heater 205 at a predetermined pressure to detect the temperature of the back surface of the heater 205. In this embodiment, a total of four thermistors are used, as described above.

Figure 3:
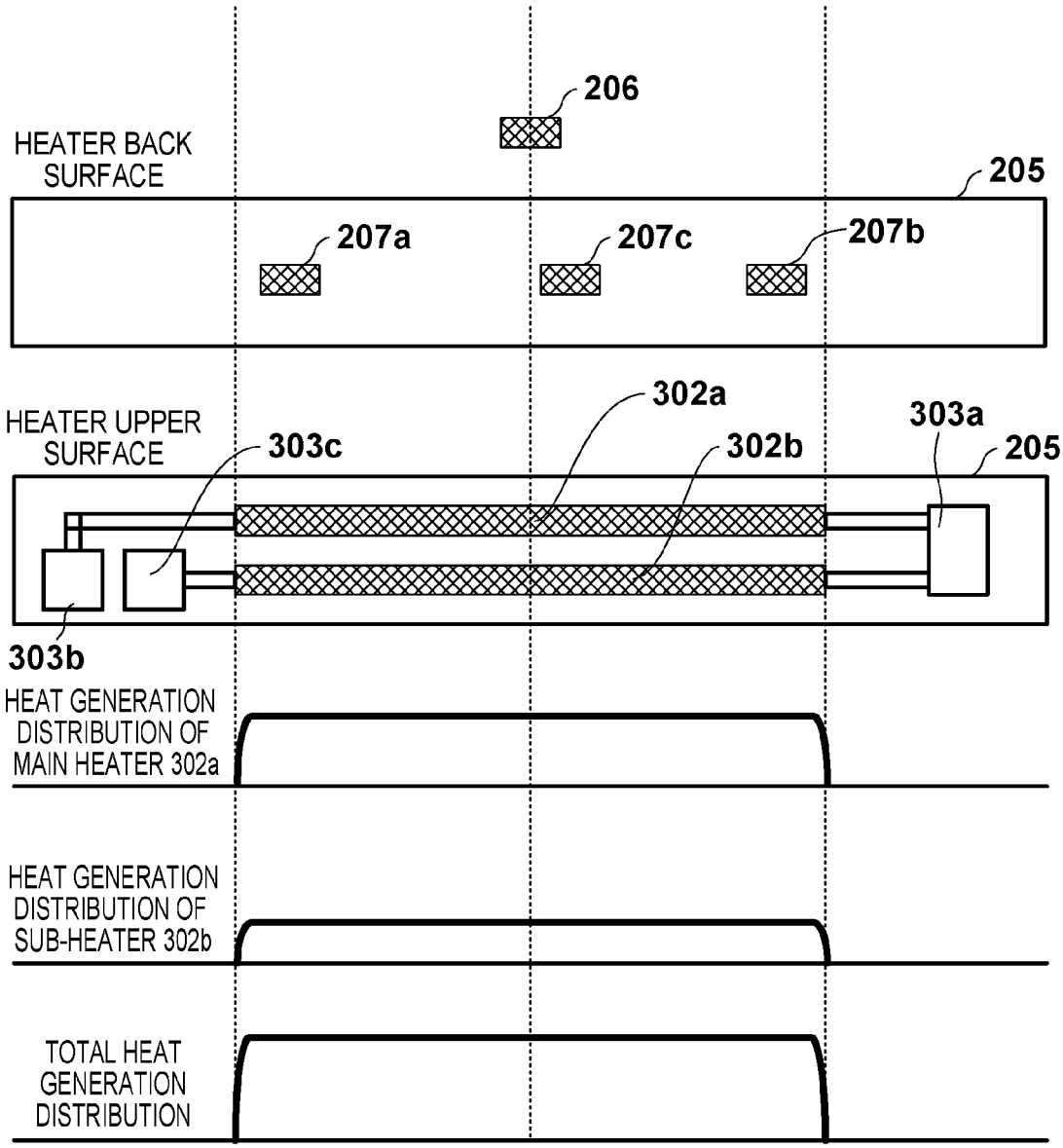
FIG. 3 is a view for illustrating the heat generation distribution and thermistor positions of a ceramic heater according to the first embodiment.

As shown in FIG. 3, the heater backside thermistors 207*a* and 207*b* are arranged at two ends of the heating element of the heater 205. The heater backside thermistor 207*c* is arranged at the center of the heating element. The sleeve thermistor 206 is arranged near the center of the fixing film.

In a state in which the rotation of the fixing film 201 by the rotation of the pressure roller 202 has become steady, and the temperature of the heater 205 has risen to a predetermined temperature, the printing paper 111 with the transferred multicolor toner image is conveyed in the direction of an arrow A to the nip portion N formed by the heater 205, the fixing film 201, and the pressure roller 202. The printing paper 111 is pressed at the nip portion N together with the fixing film 201. Heat from the heater 205 provided inside the fixing film 201 is applied to the printing paper 111 via the fixing film 201 so that the unfixed image on the printing paper 111 is thermally fixed.

(3) Ceramic Heater

FIG. 3 shows the arrangement of the heater 205 and the heat generation distribution of the heater 205. Aluminum nitride (AlN) or aluminum oxide ($Al_2O_3$) having a high thermal conductivity is used as the substrate material of the heater 205. The heater 205 extends in a direction perpendicular to the conveyance direction of the printing paper 111. That is, the longitudinal direction of the heater 205 is perpendicular to the conveyance direction of the printing paper 111.

Heating element patterns functioning as the main heater (first heating element) 302*a* and the sub-heater (second heating element) 302*b*, which are a plurality of heating elements, are arrayed in parallel to each other on the surface of the heater 205. The main heater 302*a* and the sub-heater 302*b* are covered with a glass film (not shown) serving as an electrical insulating layer. Electrodes 303*a*, 303*b*, and 303*c* are formed at the two longitudinal ends of the heater 205 to apply voltages to the main heater 302*a* and the sub-heater 302*b*.

Since each of the main heater 302*a* and the sub-heater 302*b* is formed in a uniform width in the longitudinal direction, their heat generation distributions exhibit the same tendency although the resistance values are different, as shown in FIG. 3. In addition, the main heater 302*a* and the sub-heater 302*b* are formed to have the same length in the heat generation distribution. On the other hand, the heater backside thermistors 207*a*, 207*b*, and 207*c* are arranged at the positions shown in FIG. 3 on the back surface of the heater 205.

Figure 4A:
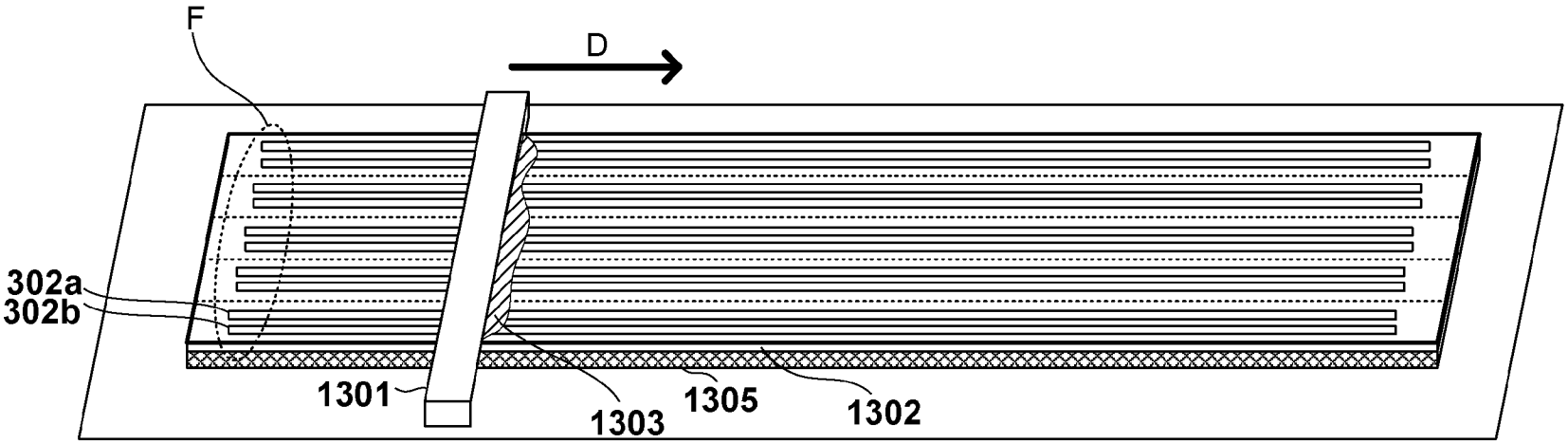
FIGS. 4A and 4B are views showing a state in which heating elements are formed on a ceramic heater substrate according to the first and second embodiments.
Figure 4B:
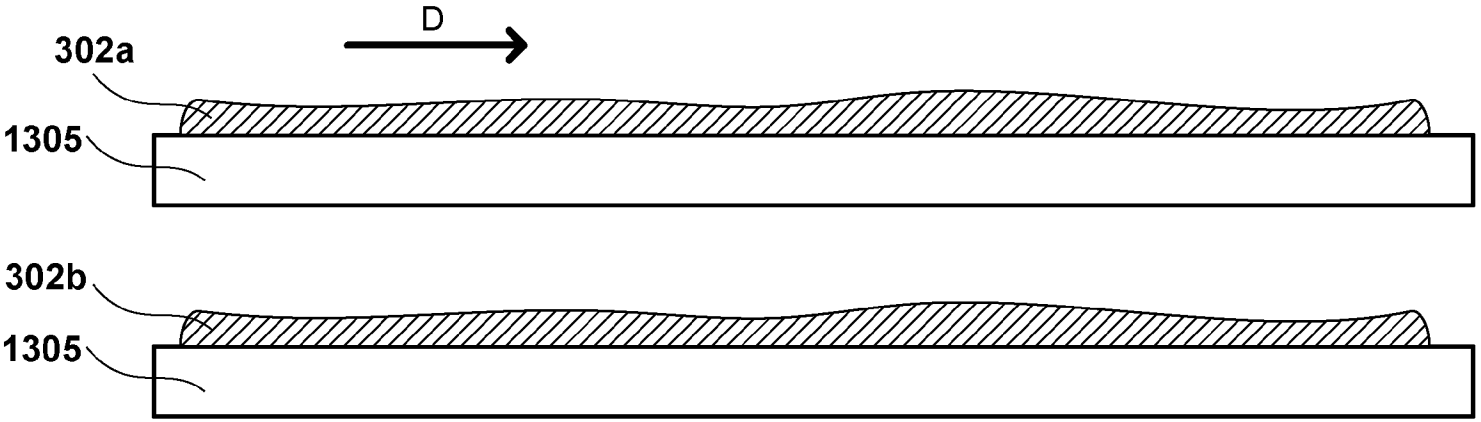

A method of creating the heating element patterns of the heater 205 will be described below. First, a predetermined metal alloy (for example, an alloy of Ag, Pd, or the like) and glass are pulverized and mixed to make a paste. The paste is screen-printed on a heater substrate 1305. The heater manufacturing step by screen printing will be explained. First, as shown in FIGS. 4A and 4B, a metal mask 1302 with a desired heating element pattern is placed on the heater substrate 1305. A paste material 1303 is dropped at a position F shown in FIG. 4A. The paste material 1303 is spread in the direction of an arrow D using a squeegee tool 1301. This allows uniform application of the paste material 1303 to the entire heater substrate 1305. This method is known to hardly make the thickness vary in a direction perpendicular to the direction of the arrow D, although the thickness slightly varies in the direction of the arrow D, as shown in FIG. 4B. The heater 205 is very long and has a size of, for example, 380 mm in the direction of the arrow D and 8 mm in the direction perpendicular to the direction of the arrow D. For this reason, the main heater 302*a* and the sub-heater 302*b* can be said to have almost the same thickness.

Next, the heater 205 with the applied paste material 1303 is baked several times to print the applied paste material 1303 on the heater substrate 1305. Finally, the heater is divided along the four dotted lines shown in FIG. 4A, thereby completing the heater 205 to be used in the fixing device 130. FIG. 4A illustrates an example in which five heaters 205 are obtained per heater substrate 1305. If the heater 205 can be narrower, the number of heaters 205 available from one heater substrate 1305 having the same size increases.

(4) Power Control

Figure 5:
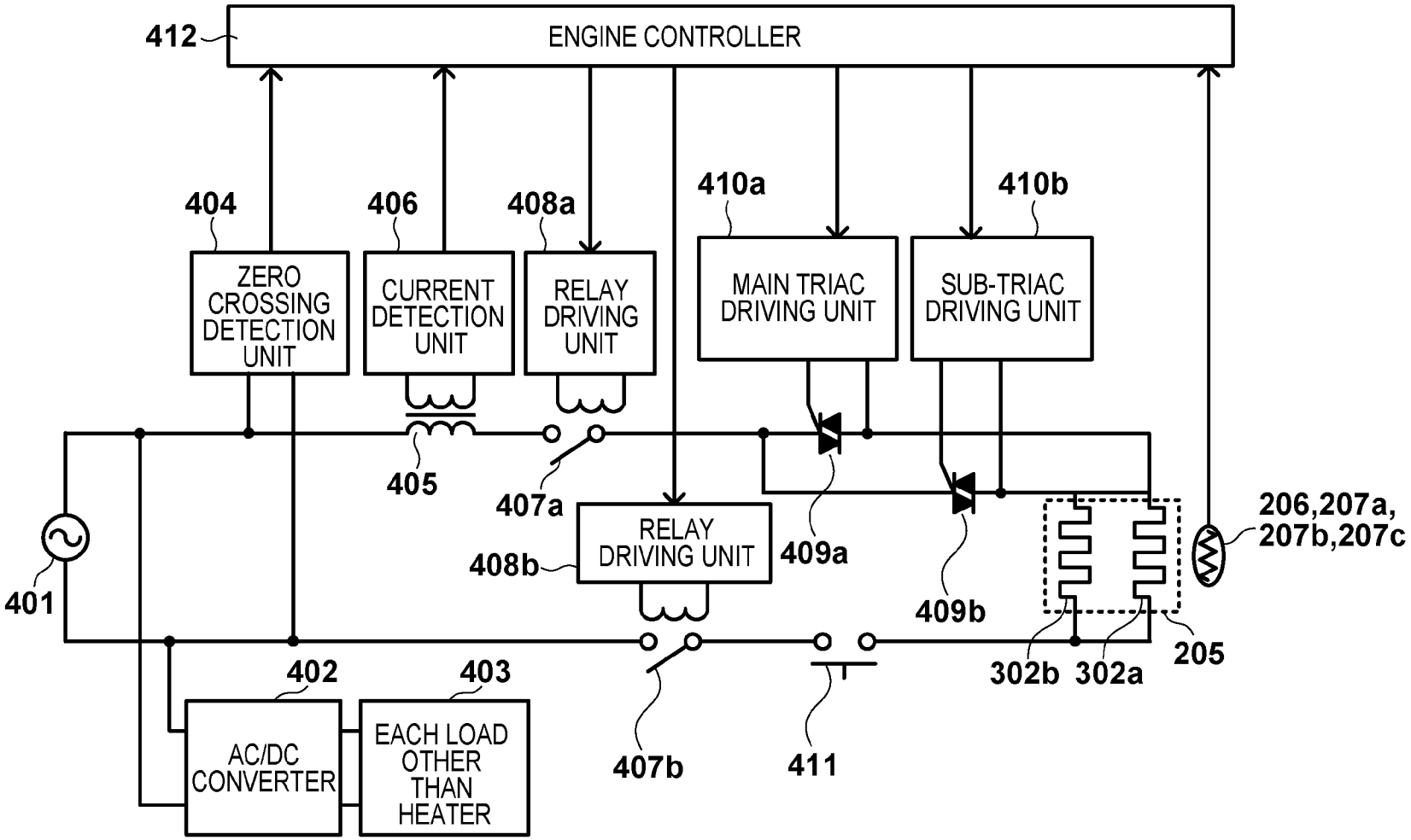
FIG. 5 is a circuit diagram concerning power control of the heater according to the first and second embodiments.

FIG. 5 shows a power supply control circuit for the heater 205. Details will be described below. Power supplied from a commercial AC power supply 401 is branched into a line to supply the power to the heater 205 and a line to supply the power to loads 403 including an engine controller 412 via an AC/DC converter 402.

The supply line to the heater 205 is connected to the main heater 302*a* and the sub-heater 302*b* via a current transformer 405, a relay 407*a*, a relay 407*b*, a thermoswitch 411, a main triac (first driving element) 409*a*, and a sub-triac (second driving element) 409*b*.

The relay 407*a* is on/off-controlled by the engine controller 412 via a relay driving unit 408*a*. The relay 407*b* is on/off-controlled by the engine controller 412 via a relay driving unit 408*b*. The relays 407*a* and 407*b* are installed on both phases of the heater 205, respectively. Hence, when both the relays 407*a* and 407*b* are released, the heater 205 is physically disconnected from the commercial AC power supply 401. The thermoswitch 411 is arranged in contact with or adjacent to the heater 205 and serves as a protective element that shuts off the power when the temperature of the heater 205 has become abnormally high. A thermal fuse may be used in place of the thermoswitch 411.

The main triac 409*a* and the sub-triac 409*b* are switching elements to be used to on/off-control energization to the main heater 302*a* and the sub-heater 302*b*, respectively. The engine controller 412 detects the temperature using the sleeve thermistor 206 and the heater backside thermistors 207*a*, 207*b*, and 207*c*. The engine controller 412 processes the temperature detected by the sleeve thermistor 206 and the heater backside thermistors 207*a*, 207*b*, and 207*c*, thereby performing control according to various situations. As basic control during fixing processing, the engine controller 412 controls the main triac 409*a* and the sub-triac 409*b* such that the temperature detected by the sleeve thermistor 206 maintains the control target temperature. That is, the engine controller 412 drives the main triac 409*a* and the sub-triac 409*b* via a main triac driving unit 410*a* and a sub-triac driving unit 410*b* based on the detected temperature information from the sleeve thermistor 206. To on/off-control the triacs, phase control shown in FIGS. 6A, 6B, and 6C is employed.

Figure 6A:
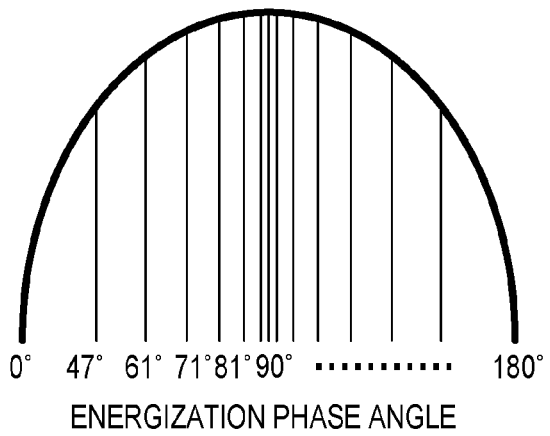
FIGS. 6A to 6C are views for illustrating phase control according to the first and second embodiments.

Phase control is a method of controlling a power to be supplied to the heater 205 by decomposing one half wave of the commercial AC power supply 401 into a plurality of phases, as shown in FIG. 6A, and turning on the main triac 409*a* and the sub-triac 409*b* at a phase angle (to be referred to as an energization phase angle hereinafter) corresponding to temperature information. Synchronization with the phase of the commercial AC power supply 401 is done using a zero crossing edge detected by a zero crossing detection unit 404.

Figure 6B:
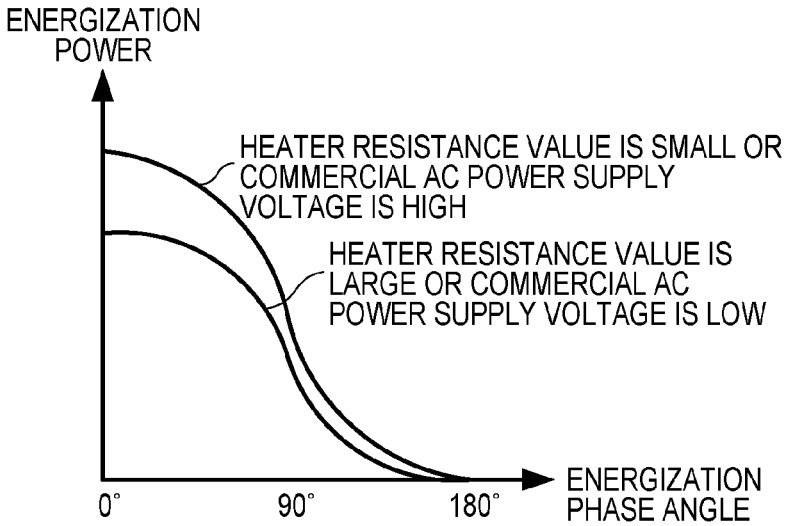

The power (proportional to the square of the current value) supplied to the heater 205 and the energization phase angle have the relationship as shown in FIG. 6B. The closer to 0° the energization phase angle is, the larger the supplied power is. The closer to 180° the energization phase angle is, the smaller the supplied power is. In particular, when the energization phase angle is 0°, the maximum power is supplied to the heater 205. When the energization phase angle is 180°, the power supplied to the heater 205 is zero. The relationship shown in FIG. 6B changes based on the resistance value of the heater 205 (the resistance value of the main heater 302*a* and the sub-heater 302*b*) and the voltage value of the commercial AC power supply 401. The larger the resistance value of the heater 205 is, or the smaller the voltage value of the commercial AC power supply 401 is, the smaller the power supplied to the heater 205 is. Conversely, the smaller the resistance value of the heater 205 is, or the larger the voltage value of the commercial AC power supply 401 is, the larger the power supplied to the heater 205 is.

Figure 6C:
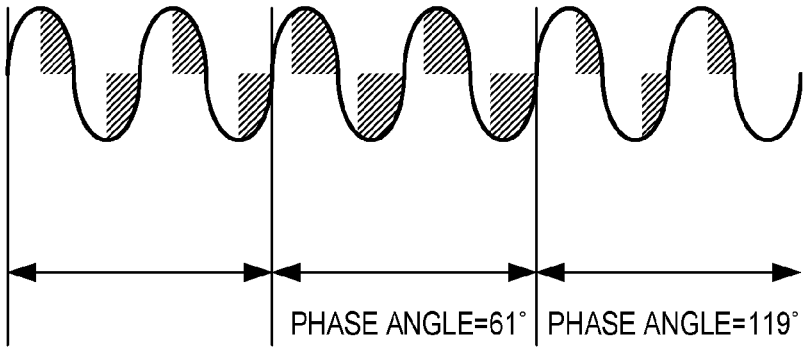

FIG. 6C shows an example of the energization pattern during control. A hatched portion indicates that the power is supplied, and a non-hatched portion indicates that no power is supplied.

(5) Constant Current Detection Circuit

The current supplied to the heater 205 is voltage-converted by the current transformer 405, converted into an effective value by a current detection unit 406, and input to the A/D port of the engine controller 412. The current detection unit 406 thus functions as a measurement unit for measuring the current supplied to the heat generation unit in the preheat stage (first control stage). The engine controller 412 controls energization to the heater 205 based on the signal input from the current detection unit so as not to make the current exceed the rated current "15 A" of the commercial AC power supply 401.

The engine controller 412 may obtain the average of current values detected by the current detection unit 406 in a plurality of periods and use it for control.

The current value detected by the current detection unit 406 is the integrated value of the half period of the frequency of the commercial AC power supply 401 and therefore depends on the frequency. Hence, frequency detection is also necessary at the same time. The engine controller 412 calculates the frequency from the interval time of the trailing edges of the pulses of a zero crossing signal detected by the zero crossing detection unit 404. The current detection arrangement is also usable as a protection circuit that releases the relays 407*a* and 407*b* when an abnormal current flows to the heater 205.

(6) Driving Motor Rotation/Stop Detection Circuit

Figure 7A:
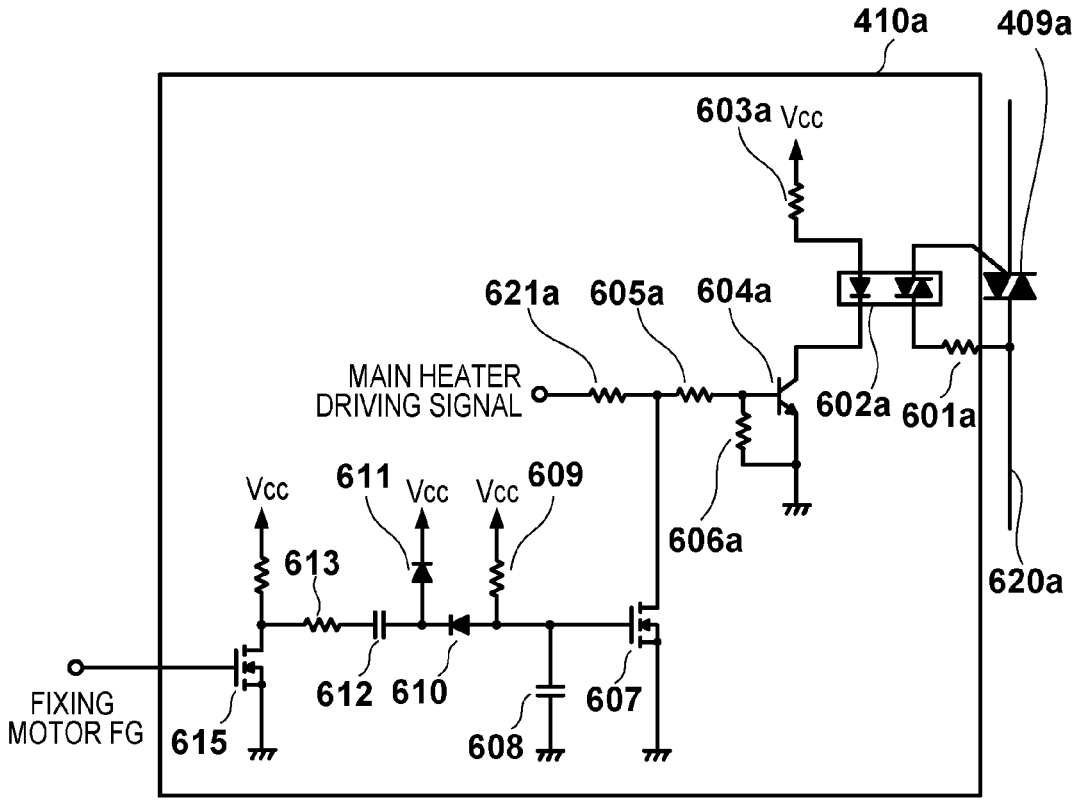
FIGS. 7A and 7B are circuit diagrams of circuits that detect rotation/stop of a driving motor and forcibly turn off a main heater driving signal according to the first embodiment.

A circuit arrangement for detecting rotation/stop of the driving motor and forcibly turning off the main triac 409*a* will be described with reference to FIGS. 7A and 7B. Note that the operations of the main triac 409*a* and the sub-triac 409*b* necessary for the description will be explained together. FIG. 7A shows the main triac driving unit 410*a*, and FIG. 7B shows the sub-triac driving unit 410*b*.

The circuit operation when supplying power to the main heater 302*a* will be described first with reference to FIG. 7A. When the engine controller 412 outputs a main heater driving signal (Hi level), a transistor 604*a* is turned on to cause the flow a current to the diode of a photo triac coupler 602*a* so that the corresponding triac is turned on. The current flows into the gate of the main triac 409*a* (or the current flows out from the gate) so that the main triac 409*a* is turned on to supply the power to the main heater 302*a* via a conductive line 620*a*. Note that resistors 605*a* and 606*a* are limiting resistors that limit the base current of the transistor 604*a*. A resistor 621*a* is a limiting resistor that limits the current of the main heater driving signal output from the engine controller 412. A resistor 603*a* is a limiting resistor that limits the diode current of the photo triac coupler 602*a*. A resistor 601*a* is a limiting resistor that limits the triac current of the photo triac coupler 602*a* and the gate current of the main triac 409*a*.

Figure 7B:
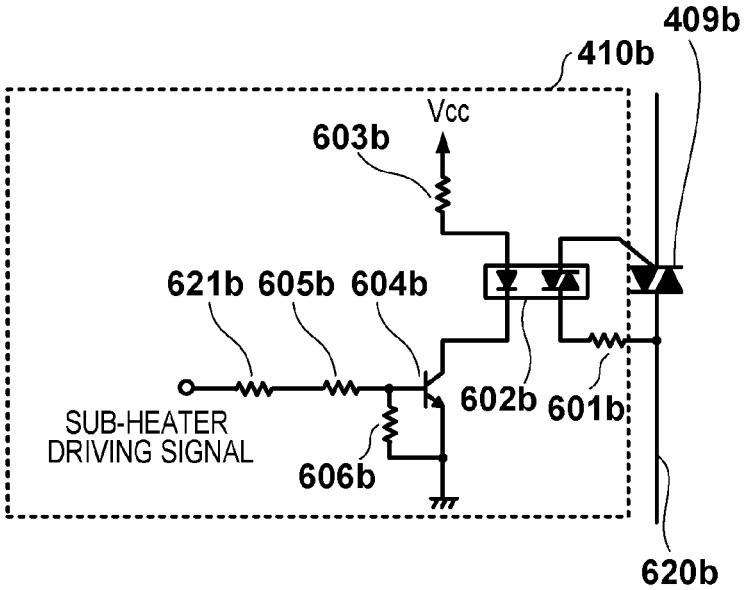

Note that the circuit operation when supplying a power to the sub-heater 302*b* can be explained similarly with reference to FIG. 7B, and a description thereof will be omitted here. That is, the operation of the circuit shown in FIG. 7B can be explained by replacing each suffix "a" in the above description with a suffix "b".

When the driving motor (not shown) formed from a brushless DC motor is at a standstill, driving of the main triac 409*a* is forcibly prohibited. As shown in FIG. 7A, the circuit is configured to subtract the current from the main heater driving signal by wired OR when the driving motor is at a standstill.

When the driving motor rotates, pulses are generated in the FG signal. An FET 615 is turned on/off in synchronism with the pulses. The logic of the FG signal when the driving motor is not rotating can be either Hi or Lo. Each operation will be described below.

<When Logic of FG Signal in Absence of Rotation of Driving Motor is Hi>

When the FG signal changes from Hi to Lo, the FET 615 is turned off. The potential of a resistor 613 rises, and charges accumulated in a capacitor 612 are removed to Vcc via a diode 611. During this time, the voltage charged in a capacitor 608 remains unchanged, and an FET 607 remains on. That is, a state in which the main heater driving signal is forced to Lo (the main heater 302*a* is forcibly turned off) continues.

<When Logic of FG Signal in Absence of Rotation of Driving Motor is Lo>

When the FG signal changes from Lo to Hi, the FET 615 is turned on. The potential of the resistor 613 decreases, and charges are accumulated in the capacitor 612 by two routes. In the first route, charges from Vcc are accumulated in the capacitor 612 via a resistor 609 and a diode 610. In the second route, charges from the capacitor 608 are accumulated in the capacitor 612 via the diode 610. When the capacitor 608 is discharged, the FET 607 is turned off. The main heater 302*a* is thus driven by the main heater driving signal.

If the FG signal is continuously fixed at Hi, charge of the capacitor 612 stops, and the current flowing from the Vcc via the resistor 609 flows into the capacitor 608 to start charging the capacitor 608. When the charge voltage of the capacitor 608 exceeds the gate ON voltage of the FET 607, the FET 607 is turned on again, and the main heater driving signal is forcibly changed to Lo (the main heater 302*a* is forcibly turned off).

As described above, the circuit shown in FIG. 7A is configured to forcibly turn off the main heater 302*a* unless the driving motor rotates to make the FG signal continuously output pulses. That is, the fixing device of this embodiment includes a safety circuit for partially limiting driving of the plurality of heating elements during stopping of rotation of the rotation member for fixing.

(7) Current Control at Time of Rise

Figure 8A:
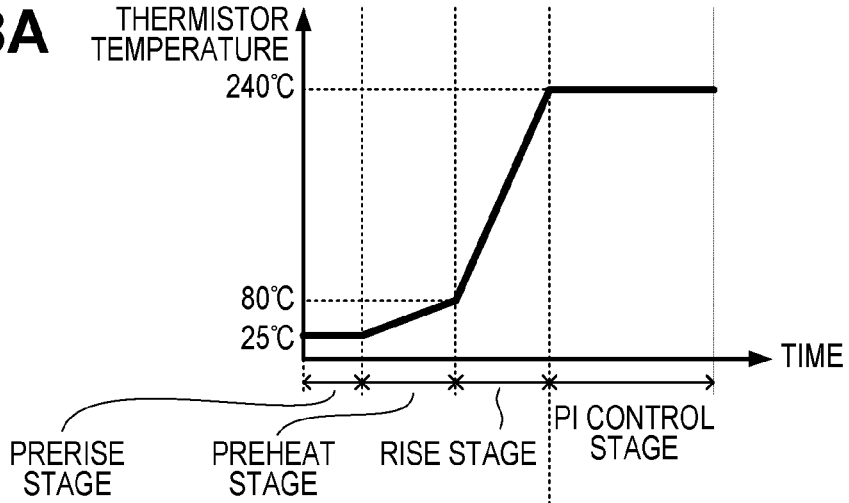
FIGS. 8A to 8C are timing charts showing thermistor heating at the time of rise according to the first and second embodiments.
Figure 8B:
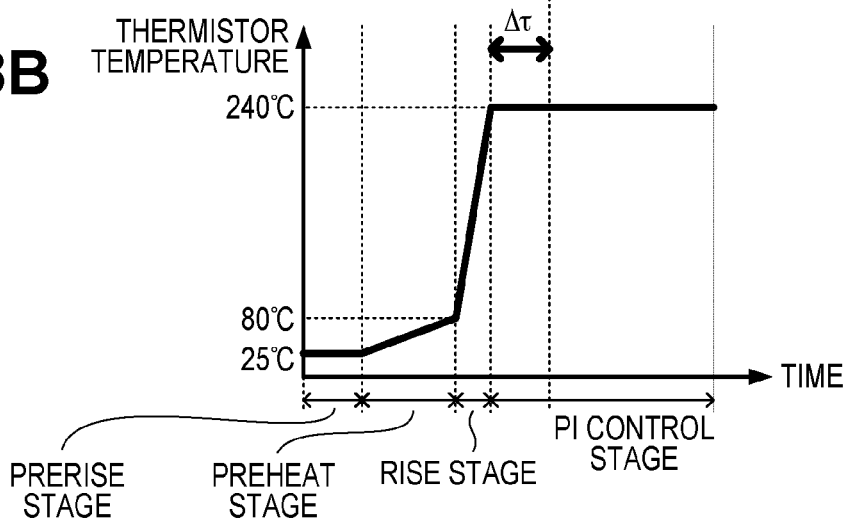
Figure 8C:
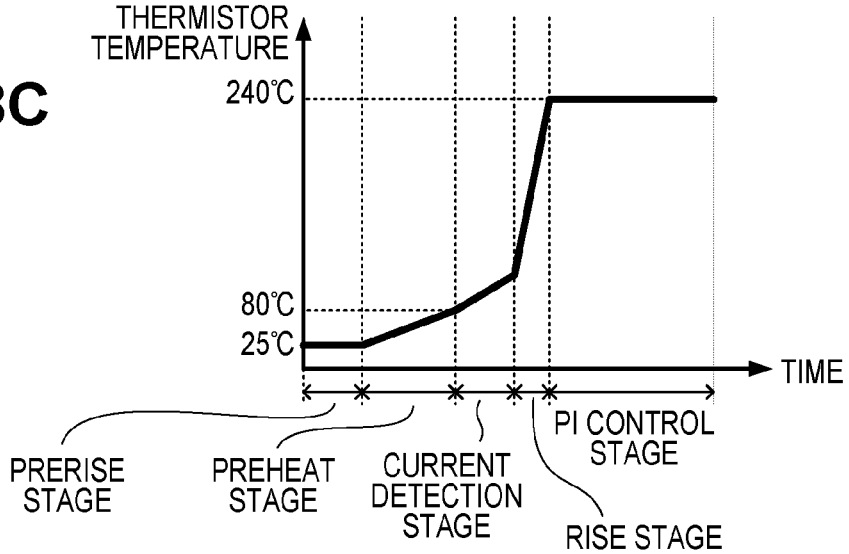

As shown in FIGS. 8A, 8B, and 8C, the temperature control stage of the heater 205 includes four stages. The first stage is the prerise stage in which the heater 205 is not energized. The second stage is the preheat stage (first control stage) in which only the sub-heater 302*b* that is a part of the plurality of heat generation unit is energized. In the preheat stage, the pressure roller 202 and the fixing film 201 are at a standstill. The third stage is the rise stage (second control stage) in which both the sub-heater 302*b* and the main heater 302*a* that comprise the plurality of heat generation units are continuously energized to raise the temperature to the target temperature. In the rise stage, the pressure roller 202 and the fixing film 201 rotate. The fourth stage is the PI control (proportional and Integral control) stage in which the temperature of the heater 205 is maintained at the target temperature. In the PI control stage, power control may be performed to maintain the temperature detected by the sleeve thermistor 206 at the target temperature.

FIG. 8A shows a control stage by a control unit including no current detection unit 406. FIG. 8B shows a control stage by a control unit including the current detection unit 406. As is apparent from comparison of FIGS. 8A and 8B, providing the current detection unit 406 makes it possible to shorten the time to reach the PI control stage by $\Delta t$. FIG. 8C shows a control stage by a control unit including the current detection unit 406 but incapable of detecting the current in the preheat stage. As described above, if the main heater 302*a* is not energized (cannot be energized due to the action of the safety circuit) in the preheat stage, it is impossible to detect the current flowing to the main heater 302*a*. In this case, a current detection stage to detect the current flowing to the main heater 302*a* after the preheat stage is necessary. In comparison of FIGS. 8B and 8C, the rise time is longer in FIG. 8C because the current detection stage is added. Hence, in the circuit arrangement that cannot detect the current flowing to the main heater 302*a* in the preheat stage, the rise time needs to be shortened.

Figure 9:
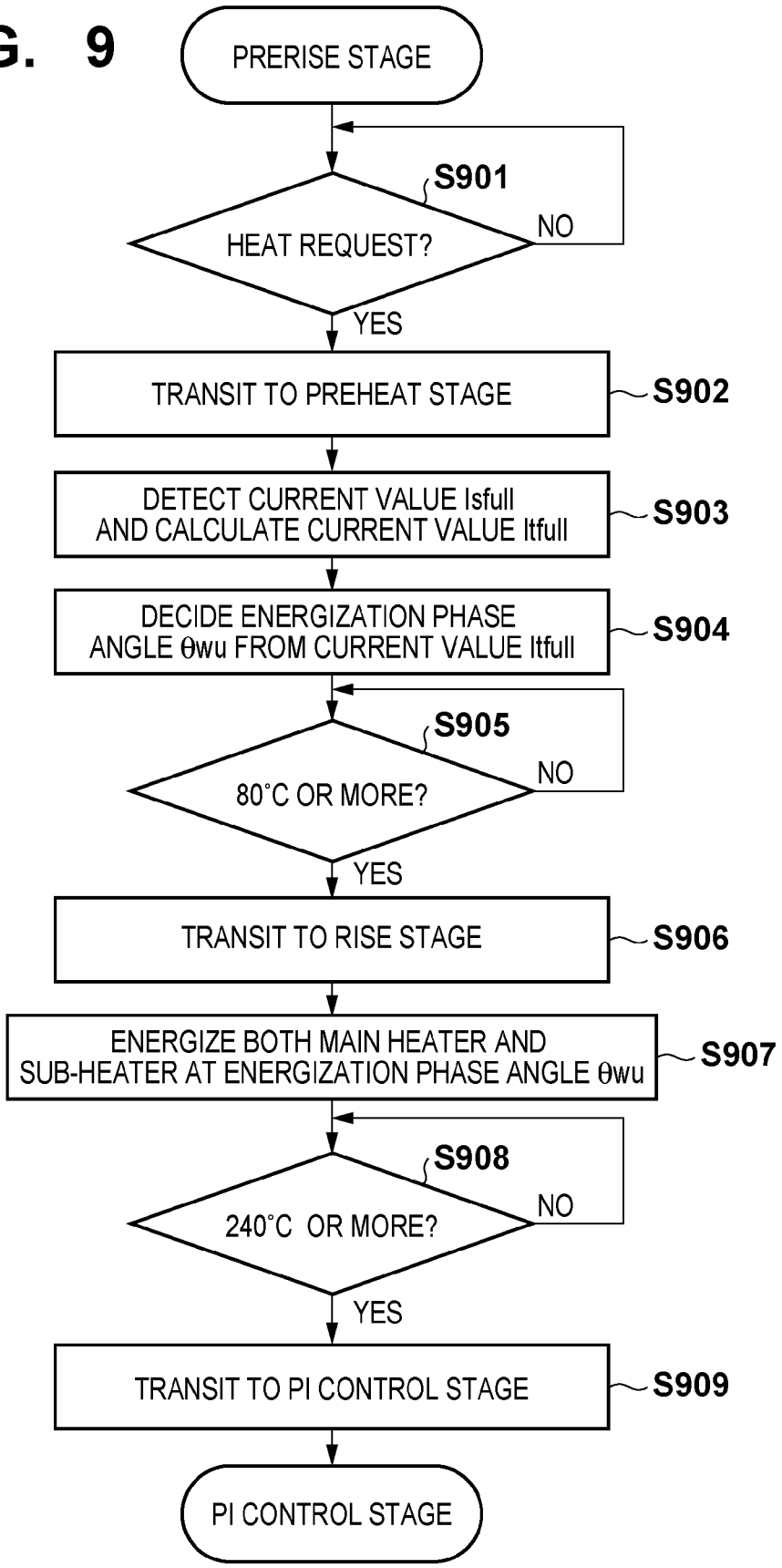
FIG. 9 is a flowchart for illustrating a control procedure for calculating a fixing current at the time of rise according to the first embodiment.

The control procedure from the "prerise stage (standby stage)" to the PI control stage will be described with reference to the flowchart of FIG. 9. This flowchart is executed by the engine controller 412.

In step S901, the engine controller 412 determines whether a heating request of the fixing device 130 is received from a printer controller or the like. If a heating request is received, the process advances to step S902.

In step S902, the engine controller 412 transits to the preheat stage. That is, the engine controller 412 starts supplying a current to the sub-heater 302*b* at an energization phase angle of 0° (maximum power).

In step S903, the engine controller 412 detects a current value $I_{sfull}$ flowing to the sub-heater 302*b* using the current detection unit 406. In addition, the engine controller 412 estimates, from the current value $I_{sfull}$, a current value $I_{tfull}$ when both the main heater 302*a* and the sub-heater 302*b* are energized at the energization phase angle of 0°. That is, the engine controller 412 functions as an estimation unit for estimating, from the current value measured by the current detection unit 406, the current value when energizing both the main heater 302*a* and the sub-heater 302*b*. Note that an example of the formula of $I_{tfull}$ is $$I_{tfull}=(1+\alpha)\cdot I_{sfull}$$

where $\alpha=R_S/R_m$. $R_s$ is the resistance value of the main heater 302*a*, and $R_m$ is the resistance value of the sub-heater 302*b*. The engine controller 412 calculates $I_{tfull}$ by multiplying the measured current value $I_{sfull}$ by the ratio of the resistance value $R_s$ of the sub-heater 302*b* to the resistance value $R_m$ of the main heater 302*a*.

When calculating the equation, the physical relationship as described above in the section of "(3) Ceramic Heater" is used, which represents that although the resistance value $R_m$ of the main heater and the resistance value $R_s$ of the sub-heater themselves slightly vary, the resistance value ratio $\alpha$ is almost constant.

In step S904, the engine controller 412 decides, from $I_{tfull}$, an energization phase angle θwu corresponding to an optimum supplied current value Iwu when the 15 A limitation is satisfied at the time of rise. This decision is done using the relationship between the energization phase angle and the energization power shown in FIG. 6B. This relationship may be implemented by a formula in advance or by a table. In either case, the engine controller 412 calculates the energization phase angle θwu from $I_{tfull}$. As described above, the engine controller 412 functions as a decision unit for deciding the energization phase angle θwu by applying the estimated current value $I_{tfull}$ to the relationship between the current value of the current supplied to the main heater 302*a* and the sub-heater 302*b* and the energization phase angle θwu corresponding to the current. In the rise stage, the engine controller 412 energizes the main heater 302*a* and the sub-heater 302*b* at the energization phase angle (power ratio) θwu.

Figure 10:
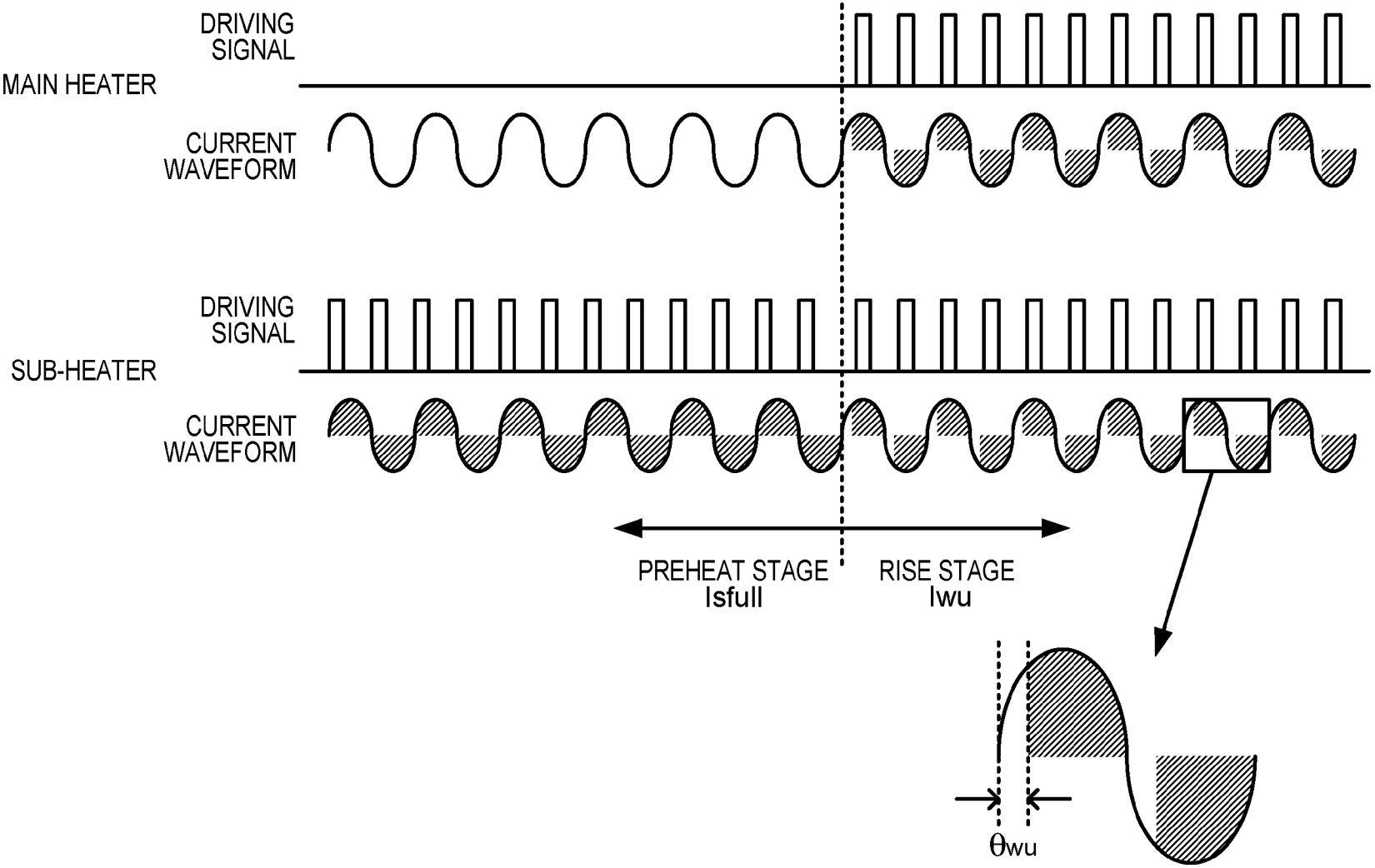
FIG. 10 is a timing chart showing a heater driving signal and the waveform of a current flowing to the heaters at the time of rise according to the first embodiment.

FIG. 10 shows a triac driving signal actually output from the engine controller 412 and the waveform of the current supplied to the main heater 302*a* and the sub-heater 302*b* in the sequence of steps S902 to S904. As is apparent from FIG. 10, only the sub-heater 302*b* is energized in the preheat stage, and energization of the sub-heater 302*b* is executed at the energization phase angle θwu in the rise stage.

In step S905, the engine controller 412 determines whether the temperature of the heater backside thermistor 207*c* has exceeded the preheat target temperature (for example, 80° C.). If the temperature of the heater backside thermistor 207*c* has reached the preheat target temperature, the process advances to step S906.

In step S906, the engine controller 412 transits the temperature control stage from the "preheat stage" to the "rise stage".

In step S907, the engine controller 412 activates the driving motor and starts supplying the power to the main heater 302*a* and the sub-heater 302*b* at the energization phase angle θwu (the current value is Iwu).

In step S908, the engine controller 412 determines whether the temperature of the heater backside thermistor 207*c* has exceeded the raise target temperature (for example, 240° C.). If the temperature of the heater backside thermistor 207*c* has reached the raise target temperature (reached the fixing enable state), the process advances to step S909.

In step S909, the engine controller 412 transits the temperature control stage from the "rise stage" to the PI control stage and starts conveying the printing paper 111.

As described above, according to this embodiment, for a heater whose energization current cannot be measured out of the plurality of heaters, the current is estimated from the measured energization current value of another heater, thereby deciding the current value suppliable to the heater whose energization current cannot be measured. For example, in the preheat stage in which the driving motor is at a standstill, only the sub-heater 302*b* is energized, and the main heater 302*a* is not energized to protect the fixing device in some cases. In such a fixing device, the energization current of the sub-heater 302*b* is measured in the preheat stage. The current suppliable to the main heater 302*a* is estimated from the measured value. This allows elimination of the stage in which the energization current of the main heater 302*a* is measured after the preheat stage and shortens the rise time.

Especially, the thicknesses (resistance paste thicknesses) of the main heater 302*a* and the sub-heater 302*b* manufactured by the manufacturing step described with reference to FIGS. 4A and 4B vary in a similar manner. It is therefore possible to accurately estimate the energization current of the main heater 302*a* from the resistance ratio.

Second Embodiment

The first and second embodiments have a common basic arrangement, and only different portions will be described. Since sections (1), (2), (4), and (5) are common, sections (3), (6), and (7) will be explained here. In particular, in the second embodiment, a sub-heater that is one of a plurality of heat generation unit constituting a heater 205 and a main heater that comprises the remaining heat generation units are alternately energized in the preheat stage.

(3') Ceramic Heater

Figure 11:
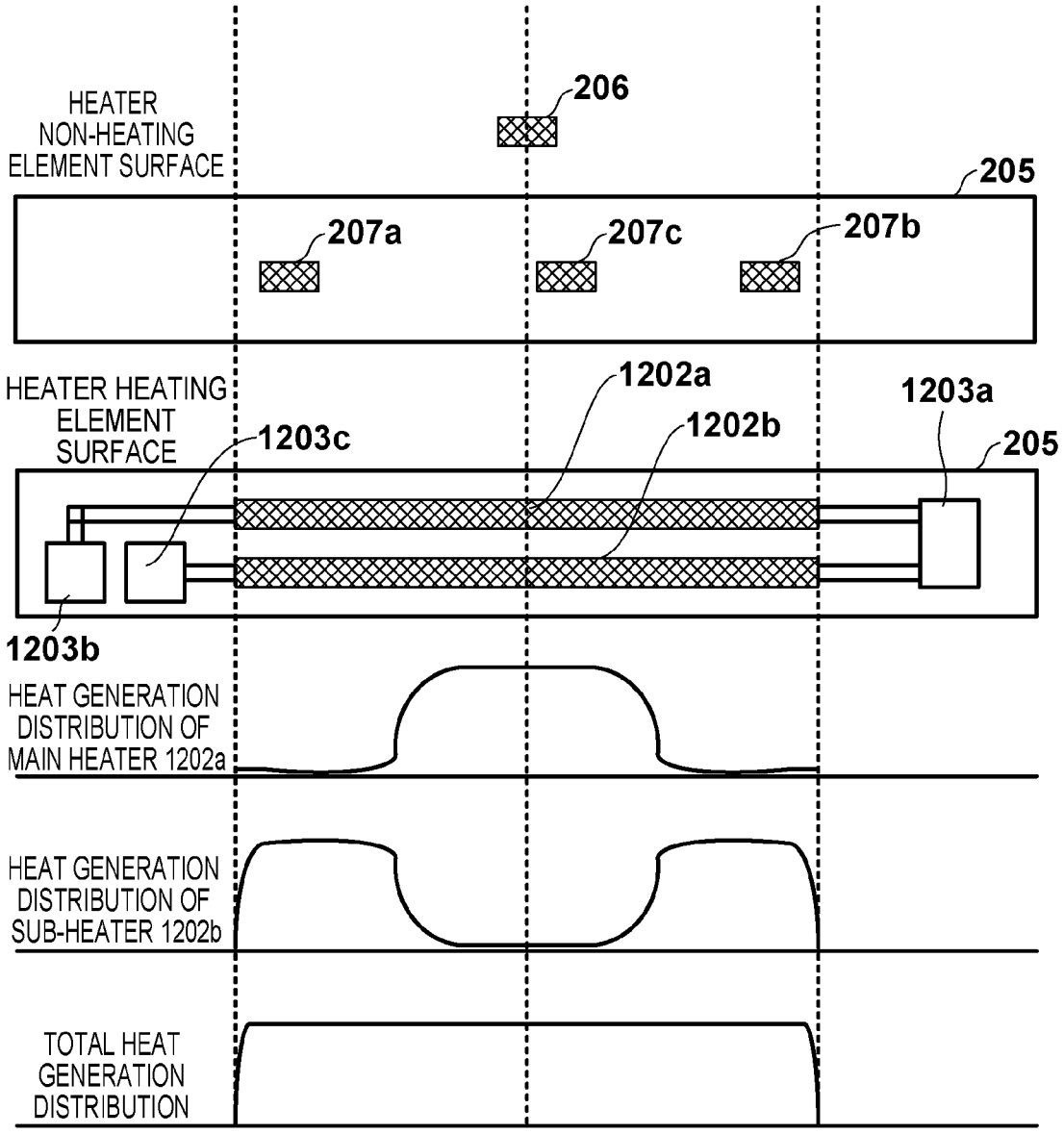
FIG. 11 is a view for illustrating the heat generation distribution and thermistor positions of a ceramic heater according to the second embodiment.

FIG. 11 shows the arrangement of the heater 205 and the heat generation distribution of the heater 205. A main heater 1202*a* and a sub-heater 1202*b* have the same arrangements as those of the above-described main heater 302*a* and the sub-heater 302*b* but different heat generation distributions, as shown in FIG. 11. In the main heater 1202*a*, the heat generation amount is large at the center of the heating element. However, in the sub-heater 1202*b*, the heat generation amount is large at the ends of the heating element. The total heat generation distribution of the main heater 1202*a* and the sub-heater 1202*b* is almost the same as the total heat generation distribution of the main heater 302*a* and the sub-heater 302*b*.

In the film heating scheme, when printing paper 111 having a narrow paper width passes, the longitudinal ends of the heater 205 become hotter than the center. To relax the hot state, control is performed to decrease the conveyance speed of the printing paper 111. To do this, when both or one of heater backside thermistors 207*a* and 207*b* detects a predetermined temperature or more, an engine controller 412 weakens energization to the sub-heater 1202*b* relative to the main heater 1202*a*. This allows the suppression of overheating of the ends of the heater 205 and continuously conveys the printing paper 111 while minimizing the decrease in the conveyance speed.

(6') Driving Motor Rotation/Stop Detection Circuit

Figure 12A:
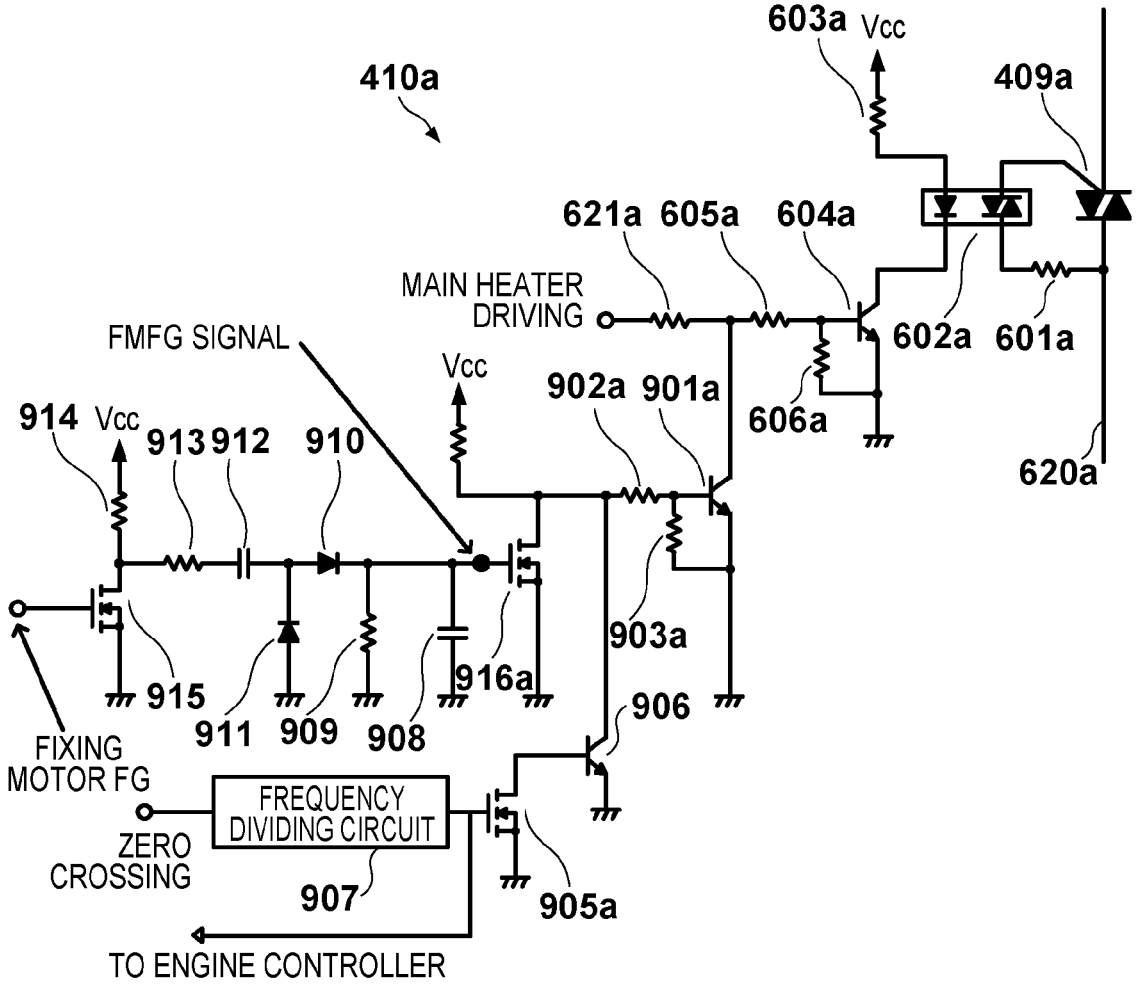
FIGS. 12A and 12B are circuit diagrams of circuit that detect rotation/stop of a driving motor and forcibly turn off a predetermined heater driving signal based on a zero crossing frequency-divided signal according to the second embodiment.
Figure 12B:
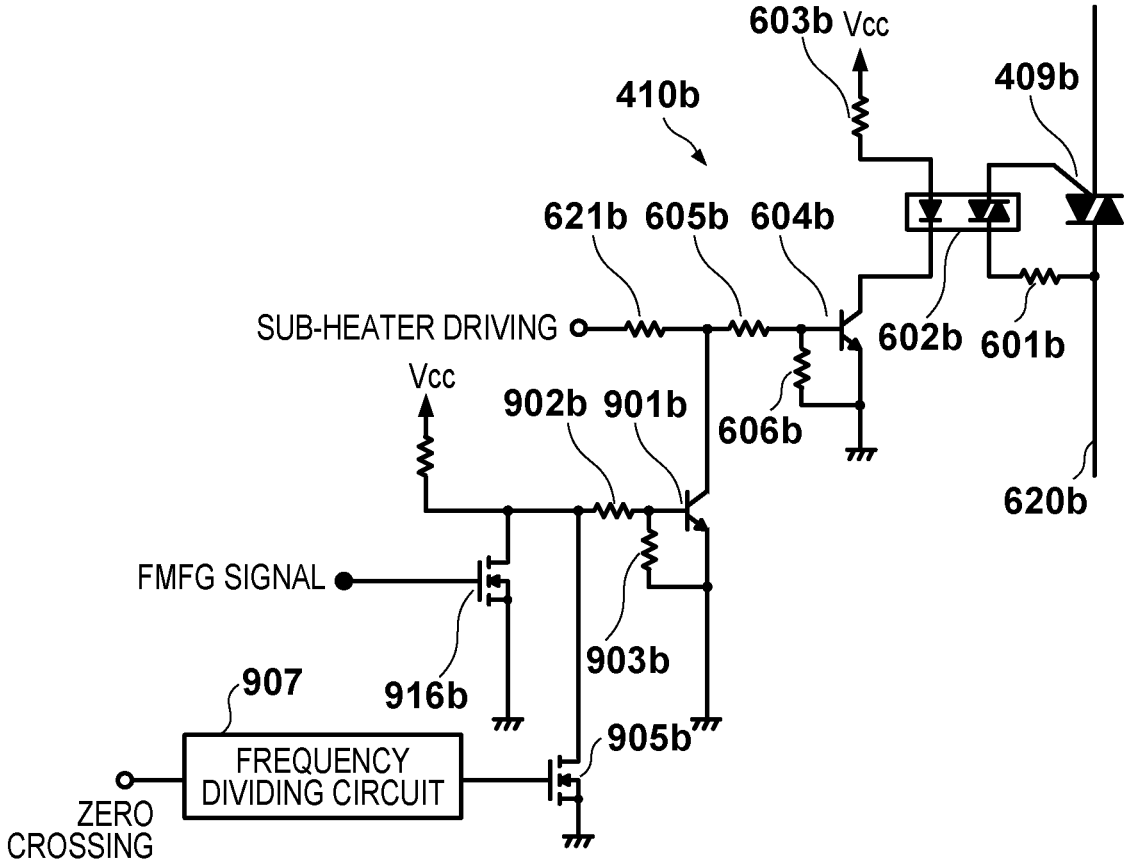

A circuit arrangement for detecting rotation/stop of the driving motor and forcibly turning off one of a main triac 409*a* and a sub-triac 409*b* will be described with reference to FIGS. 12A and 12B. FIG. 12A shows a main triac driving unit 410*a*, and FIG. 12B shows a sub-triac driving unit 410*b*. Note that the operations of the main triac 409*a* and the sub-triac 409*b* necessary for the description are the same as in the first embodiment, and a description thereof be omitted. A driving motor rotation detection circuit and a zero crossing frequency-divided signal detection circuit will be described.

The zero crossing frequency-divided signal detection circuit will be explained first. A zero crossing detection unit 404 outputs a zero crossing signal that is a pulse signal in synchronism with the zero crossing point of the voltage of a commercial AC power supply 401. A frequency dividing circuit 907 frequency-divides the zero crossing signal (this signal will be referred to as a frequency-divided signal) and inputs it to the gates of FETs 905*a* and 905*b*. The FETs 905*a* and 905*b* are turned on/off in synchronism with the frequency-divided signal. The main triac driving unit 410*a* shown in FIG. 12A further provides a transistor 906 at the succeeding stage of the FET 905*a* to obtain a logic reverse to that of the sub-triac driving unit 410*b* shown in FIG. 12B.

The driving motor rotation detection circuit will be described next. When the driving motor rotates to generate pulses in the FG signal, an FET 915 is turned on/off in synchronism with the pulses. The logic of the FG signal when the driving motor is not rotating can be either Hi or Lo. Each operation will be described below.

<When Logic of FG Signal in Absence of Rotation of Driving Motor is Lo>

When the FG signal changes from Lo to Hi, the FET 915 is turned on. The potential of a resistor 913 decreases, and charges accumulated in a capacitor 912 are removed to GND via a diode 911, the resistor 913, and the FET 915. During this time, a state in which no charges are accumulated in a capacitor 908 continues, and FETs 916*a* and 916*b* remain off.

<When Logic of FG Signal in Absence of Rotation of Driving Motor is Hi>

When the FG signal changes from Hi to Lo, the FET 915 is turned off. The potential of the resistor 913 rises, and charges from Vcc are accumulated in the capacitor 912 via a resistor 914 and the resistor 913. In addition, charges are accumulated in the capacitor 908 via a diode 910. When the charges are accumulated in the capacitor 908, the FETs 916*a* and 916*b* are turned on.

If the FG signal is continuously fixed at Lo, charge of the capacitor 912 stops. Simultaneously, charge of the capacitor 908 stops. The capacitor 908 starts discharging via a resistor 909. When the discharge voltage of the capacitor 908 falls below the gate OFF voltage of the FETs 916*a* and 916*b*, the FETs 916*a* and 916*b* are turned off again. The resistors 902*a* and 903*a* are limiting resistors that limit the base current of a transistor 901*a*. The resistors 902*b* and 903*b* are limiting resistors that limit the base current of a transistor 901*b*.

As described above, in the circuits shown in FIGS. 12A and 12B, if the driving motor rotates to make the FG signal continuously output pulses, the FET 916*a* is turned on, and the transistor 901*a* is forcibly turned off. Alternatively, the FET 916*b* is turned on, and the transistor 901*b* is forcibly turned off. If the driving motor stops, and the FG signal does not continuously output pulses, the FET 916*a* is turned off, and the transistor 901*a* depends on the on/off state of the transistor 906. Alternatively, the FET 916*b* is turned off, and the transistor 901*b* depends on the on/off state of the transistor 905. That is, when the driving motor stops, one of the main heater 1202*a* and the sub-heater 1202*b* is forcibly turned off in accordance with the frequency-divided signal.

(7') Current Control at Time of Rise

Figure 13:
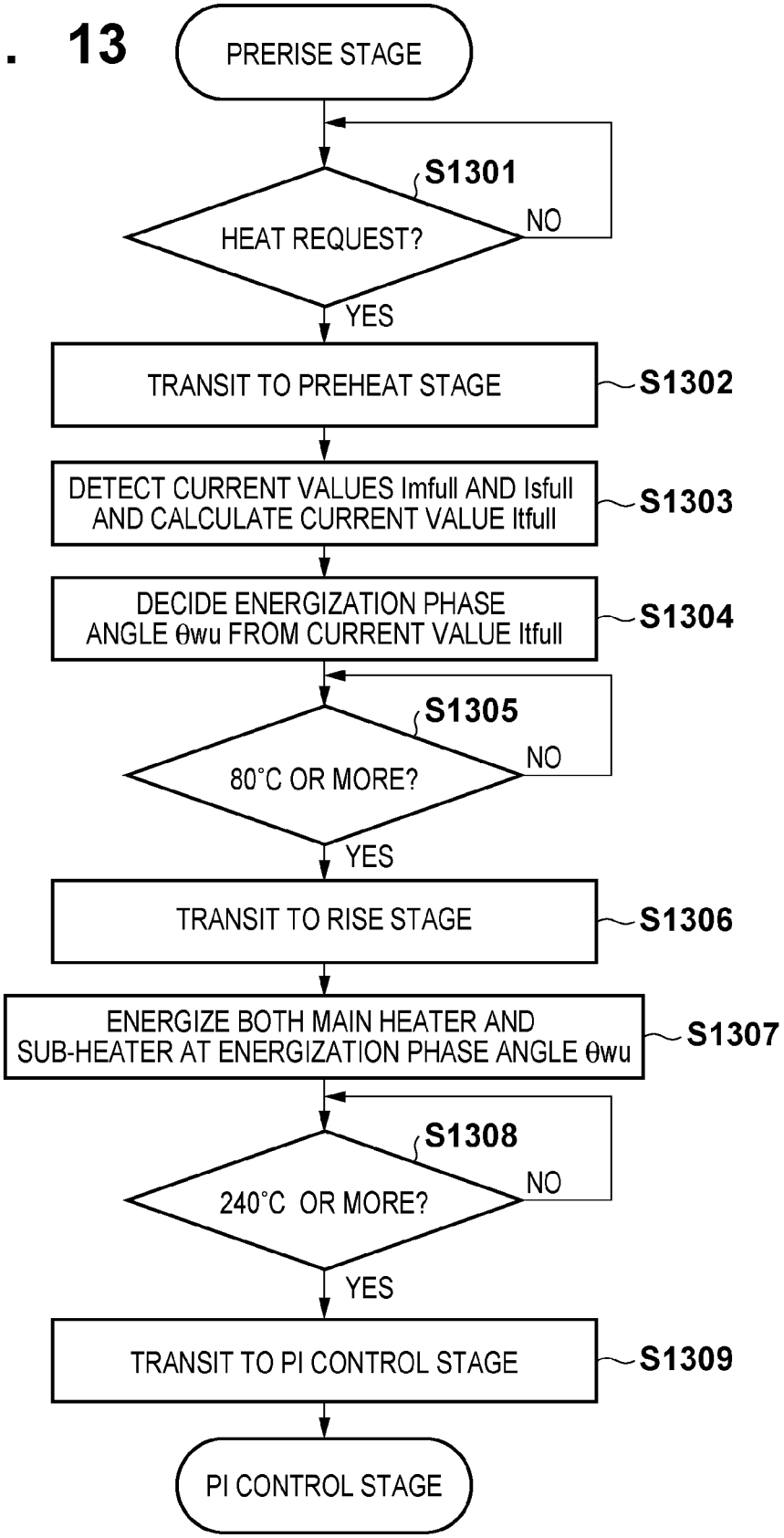
FIG. 13 is a flowchart for illustrating a control procedure for calculating a fixing current at the time of rise according to the second embodiment.

The control procedure from the prerise stage to the PI control stage will be described with reference to the flowchart of FIG. 13. This flowchart is executed by the engine controller 412.

In step S1301, the engine controller 412 determines whether a heating request is received. If a heating request is received, the process advances to step S1302. In step S1302, the engine controller 412 transits the temperature control stage from the "prerise stage" to the "preheat stage". The engine controller 412 energizes one of the main heater 1202*a* and the sub-heater 1202*b* at an energization phase angle of 0° (maximum power). In this energization, the main heater 1202*a* and the sub-heater 1202*b* are alternately energized in synchronism with the frequency-divided signal described in the section of "(6') Driving Motor Rotation/Stop Detection Circuit".

In step S1303, the engine controller 412 detects current values $I_{mfull}$ and $I_{sfull}$ using a current detection unit 406, and estimates a current value $I_{tfull}$ from the current values $I_{mfull}$ and $I_{sfull}$. That is, the engine controller 412 functions as an estimation unit for estimating, from the current values measured by the current detection unit 406, the current value when energizing both the main heater 1202*a* and the sub-heater 1202*b*. Note that the current value $I_{tfull}$ is the total current value when both the main heater 1202*a* and the sub-heater 1202*b* are energized at the energization phase angle of 0°. An example of the formula of $I_{tfull}$ is $$I_{tfull}=I_{mfull}+I_{sfull}$$

The engine controller 412 thus adds the value of the current supplied to the sub-heater 1202*b* and the value of the current supplied to the main heater 1202*a*, thereby calculating the current value $I_{tfull}$ when energizing both the main heater 1202*a* and the sub-heater 1202*b*.

Figure 14:
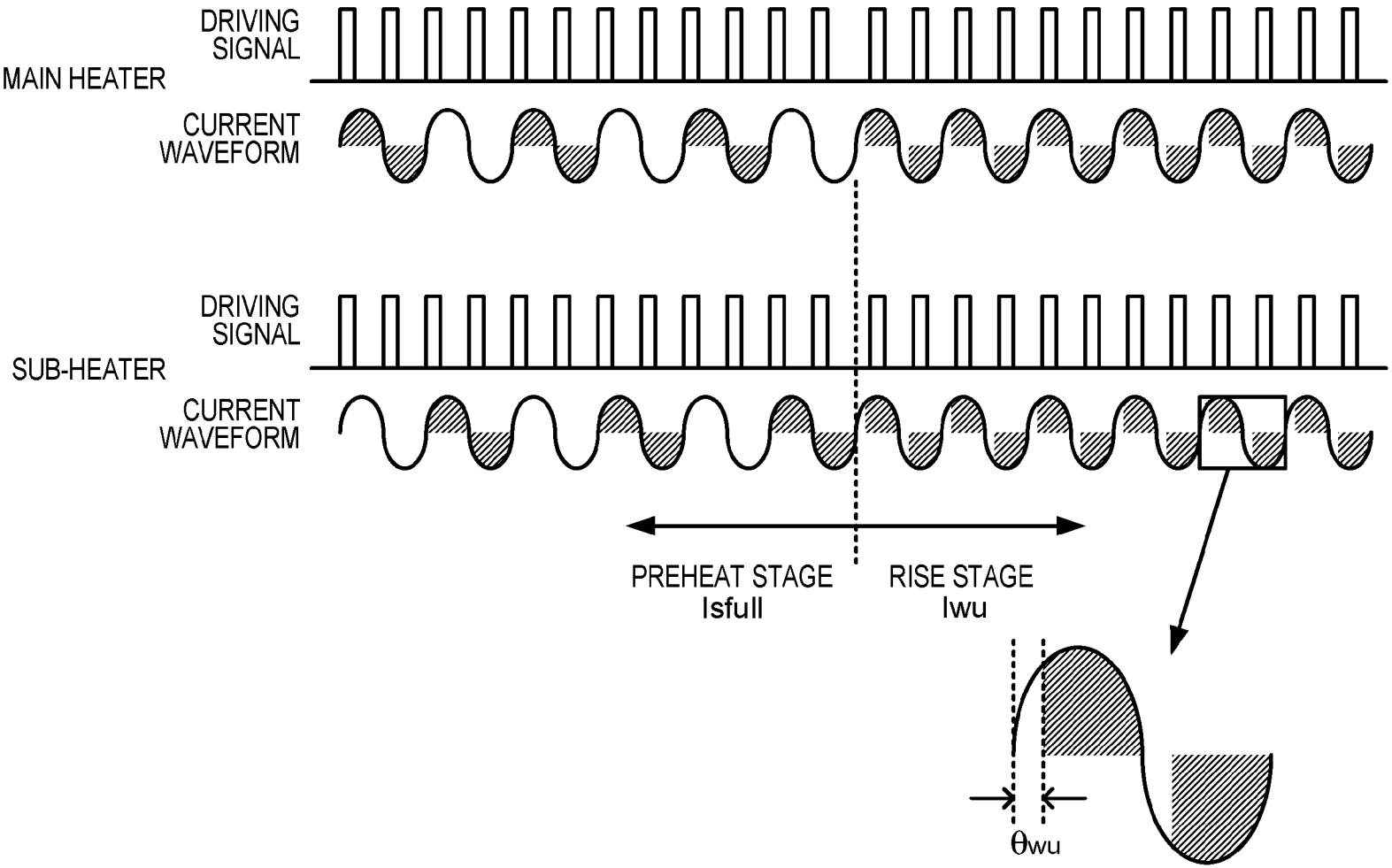
FIG. 14 is a timing chart showing a heater driving signal and the waveform of a current flowing to the heaters at the time of rise according to the second embodiment.

In step S1304, the engine controller 412 calculates an energization phase angle θwu from $I_{tfull}$ using the relationship between the energization phase angle and the detected current. FIG. 14 shows a triac driving signal actually output from the engine controller 412 and the waveform of the current supplied to the main heater 1202*a* and the sub-heater 1202*b* in the sequence of steps S1302 to S1304. As shown in FIG. 14, the main heater 1202*a* and the sub-heater 1202*b* are alternately energized in the preheat stage. That is, the main heater 1202*a* and the sub-heater 1202*b* are never energized simultaneously. In the rise stage after that, both are energized. In the rise stage, the current supplied to the main heater 1202*a* and the sub-heater 1202*b* is Iwu, and the energization phase angle is θwu.

Steps S1305 to S1309 are the same as steps S905 to S909 described above, and a description thereof will be omitted.

As described above, in the arrangement for alternately energizing two heating element groups when the driving motor is at a standstill, current detection is performed during the preheat sequence to estimate the current value suppliable to all heating elements, thereby shortening the rise time of the image forming operation. In addition, the temperature of the heater is uniform in the longitudinal direction, and the whole grease can melt uniformly.

As in the above-described first and second embodiments, if the control unit sets the power ratio of the powers to be supplied to the plurality of heating elements during the period the rotation member for fixing rotates to raise the fixing device to the fixing enable state in accordance with the current detected by the current detection unit when the rotation member for fixing stops rotation, and driving of the plurality of heating elements is partially limited, an appropriate power can be supplied to the heating elements while suppressing an increase in the time necessary for the rise.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-133538, filed Jun. 15, 2011, which is hereby incorporated by reference herein in its entirety.

What is claimed is:

1. A fixing device comprising:

a rotation member configured to fix an image;

a plurality of heating elements configured to heat said rotation member;

a control unit configured to control power to be supplied to said plurality of heating elements in accordance with temperature information;

a circuit configured to partially limit driving of said plurality of heating elements when said rotation member stops rotation; and a current detection unit provided in a current supply path from a power supply to said plurality of heating elements, wherein said control unit is further configured to set a power ratio of the power to be supplied to said plurality of heating elements during a period in which said rotation member rotates to raise the fixing device to a fixing enable state in accordance with a current detected by said current detection unit when said rotation member stops rotation, and driving of said plurality of heating elements is partially limited.

2. The device according to claim 1, wherein said circuit is further configured to limit the number of heating elements generating heat when said rotation member stops rotation.

3. The device according to claim 1, wherein said circuit is further configured to limit said plurality of heating elements in a manner so as not to generate heat simultaneously.

4. The device according to claim 1, wherein said rotation member includes a film-like rotation member.

5. The device according to claim 4, wherein said plurality of heating elements are provided on a substrate of a heater, and said heater is in contact with an inner surface of said rotation member.

6. The device according to claim 5, wherein said plurality of heating elements are formed on the substrate using screen printing.

7. The device according to claim 1, wherein said current detection unit is further configured to detect a sum of currents flowing to heating elements to which the power is supplied from the power supply.

8. The device according to claim 1, wherein said control unit has a preheat stage in which said rotation member stops rotation, and driving of said plurality of heating elements is partially limited, and a rise stage in which said rotation member rotates to raise the fixing device to the fixing enable state, and in the preheat stage, said control unit estimates, from the current detected by said current detection unit, a sum of currents flowing to all of said plurality of heating elements when all of said plurality of heating elements are driven, and sets, based on the estimated sum of the currents, the power ratio of the power to be supplied to said plurality of heating elements.

9. The device according to claim 8, wherein said control unit is further configured to set the power ratio based on the current detected by said current detection unit in the preheat stage, and to set a resistance value ratio $\alpha$ of a resistance value of each heating element that is driven in the preheat stage to a resistance value of each heating element that is not driven in the preheat stage.

10. The device according to claim 1, wherein said control unit has a preheat stage in which said rotation member stops rotation, and driving of said plurality of heating elements is partially limited, and a rise stage in which said rotation member rotates to raise the fixing device to the fixing enable state, in the preheat stage, said circuit alternately drives some heating elements out of said plurality of heating elements and the remaining heating elements out of said plurality of heating elements, and in the preheat stage, said control unit sets the power ratio based on a current detected by said current detection unit when said some heating elements are driven, and a current detected by said current detection unit when said remaining heating elements are driven.

* * * * *